US011013653B1

(12) United States Patent
Atkins et al.

(10) Patent No.: US 11,013,653 B1
(45) Date of Patent: May 25, 2021

(54) CAREGIVER LIFTING HARNESS AND USE THEREOF

(71) Applicants: Christopher Atkins, Victoria (CA); Arthur Makosinski, Victoria (CA)

(72) Inventors: Christopher Atkins, Victoria (CA); Arthur Makosinski, Victoria (CA)

( * ) Notice: Subject to any disclaimer, the term of this patent is extended or adjusted under 35 U.S.C. 154(b) by 0 days.

(21) Appl. No.: 17/157,252

(22) Filed: Jan. 25, 2021

(51) Int. Cl.
*A61G 7/10* (2006.01)

(52) U.S. Cl.
CPC ..... *A61G 7/1038* (2013.01); *A61G 7/104* (2013.01)

(58) Field of Classification Search
CPC ..... A61G 7/1038; A61G 7/104
See application file for complete search history.

(56) References Cited

U.S. PATENT DOCUMENTS 1,535,208 A * 4/1925 Drennan ..... A61G 7/1088 224/158
3,258,788 A * 7/1966 Anciaux ..... A61G 1/044 5/625
3,938,718 A * 2/1976 Madison ..... A45F 3/10 224/262
4,280,645 A 7/1981 Goodden
D267,598 S * 1/1983 Lyer ..... D29/101.1
5,370,286 A * 12/1994 Newman ..... A45F 3/14 119/857
6,311,346 B1 * 11/2001 Goldman ..... A61F 5/37 128/876
6,361,478 B1 * 3/2002 Giancaspro ..... A47D 13/086 128/875
6,508,389 B1 * 1/2003 Ripoyla ..... A45F 3/14 182/3
6,729,511 B2 5/2004 Dent
6,790,201 B2 * 9/2004 Meyer ..... A61M 25/02 224/257
7,331,493 B2 * 2/2008 Dent, III ..... A44B 11/08 224/157
7,709,714 B2 * 5/2010 Harbaugh ..... G10G 5/005 84/327
7,780,049 B1 * 8/2010 Baranoski ..... A45F 3/14 224/250
7,785,244 B2 * 8/2010 Hetrick ..... A63B 21/4017 482/139
8,657,166 B1 2/2014 Harness
9,642,444 B2 * 5/2017 Krol ..... A45F 3/14
9,930,955 B2 * 4/2018 Nielsen ..... A45F 3/14
9,932,208 B2 * 4/2018 Mealy ..... A62B 35/0075
(Continued)

FOREIGN PATENT DOCUMENTS

CA 2362089 5/2003

*Primary Examiner* — David R Hare
*Assistant Examiner* — Alexis Felix Lopez
(74) *Attorney, Agent, or Firm* — Baumgartner Patent Law; Marc Baumgartner

(57) ABSTRACT

A lifting harness for assisting a worker to transfer a load is provided, the lifting harness comprising: a belt; a pair of lifting pads slidably mounted on the belt; a back including a pair of arms attached to the belt, the pair of arms converging towards a distal end; a loop proximate to the distal end; and a mobile lifting strap, the mobile lifting strap including a strap first distal end, a strap second distal end and a length therebetween, the length slidably extending through the loop; a first lifting loop proximate to the strap first distal end; and a second lifting loop proximate to the strap second distal end.

12 Claims, 8 Drawing Sheets

(56) References Cited

U.S. PATENT DOCUMENTS

| | | | | |
|---|---|---|---|---|
| D907,857 | S * | 1/2021 | Nielsen | D29/101.1 |
| 2002/0148866 | A1* | 10/2002 | Dent | A45F 3/14 224/259 |
| 2004/0149790 | A1* | 8/2004 | Kassai | A47D 13/025 224/160 |
| 2005/0132495 | A1 | 6/2005 | Girard | |
| 2005/0263347 | A1* | 12/2005 | Hill | A62B 35/0018 182/3 |
| 2005/0279791 | A1* | 12/2005 | Komorowski | A45F 3/14 224/260 |
| 2006/0137097 | A1 | 6/2006 | Frost | |
| 2006/0162069 | A1 | 7/2006 | Mowery | |
| 2007/0033713 | A1* | 2/2007 | Carreon | A45C 13/30 2/327 |
| 2007/0066450 | A1* | 3/2007 | Hetrick | A63B 21/068 482/91 |
| 2007/0131726 | A1* | 6/2007 | Aliev | A45F 3/14 224/184 |
| 2010/0282808 | A1* | 11/2010 | Debnam | A41D 13/0007 224/637 |
| 2010/0299830 | A1 | 12/2010 | Thomas | |
| 2011/0023231 | A1 | 2/2011 | Thomas | |
| 2013/0146629 | A1 | 6/2013 | Glines | |
| 2015/0136145 | A1 | 5/2015 | Binder | |
| 2016/0262967 | A1 | 9/2016 | Mitchell | |
| 2017/0027796 | A1 | 2/2017 | Kaikenger | |
| 2018/0214329 | A1 | 8/2018 | Mitchell | |
| 2020/0138658 | A1 | 5/2020 | Kaikenger | |

* cited by examiner

CAREGIVER LIFTING HARNESS AND USE THEREOF

FIELD OF THE INVENTION

The present technology is an adjustable harness for a worker to wear to assist them in lifting and moving a weight. More specifically, it is a harness that allows a caregiver to lift a patient weighing in excess of what they would be able to lift, if unassisted.

BACKGROUND

Health care workers and other workers who must lift heavy weights are prone to back, arm and shoulder strains and injury. For this reason, many lift systems have been developed. In the health care industry, many involve the use of a gantry or rail system and a sling for the patient. Two person harnesses are more common in industries where heavy loads are lifted.

An example of a patient lift system is disclosed in United States Patent Application Publication No. 20200138658. It discloses a patient lift system that includes a lift unit operable to raise and lower a lifting strap, the lift unit having a working load rating. A sling bar is attached with the lifting strap and a lifting accessory is coupled to the sling bar. The lifting accessory may comprise: a lifting sling; a lifting harness; a lifting vest; a lifting strap; or a repositioning sheet. The sling bar includes an opening sized to receive one or more attachment handles of the lifting accessory if the working load rating of the lift unit is larger than the working load rating of the lifting accessory. The opening of the sling bar is not capable of receiving one or more attachment handles of the lifting accessory if the working load rating of the lift unit is smaller than the working load rating of the lifting accessory. This requires a gantry or rail and a power lift unit. Further, the patient has to be positioned in the lifting accessory, which may limit the utility of the system.

United States Patent Application Publication No. 20180214329 and 20160262967 disclose a caregiver's helper lift that utilizes a unique hoisting apparatus, a lifting harness worn by a patient, and a control apparatus to allow a caregiver to raise and lower a patient into/out-of a wheelchair and into/out-of a vehicle, down to or up off a floor, or to any other position/location that a patient needs to be moved. The lifting harness can clip to a lift attachment which is affixed to a helper lift suspension cable/rope/etc. The caregiver's helper lift utilizes a crane arm to suspend the patient and allow him or her to be repositioned by simply rolling/turning the lift. By actuating the hoisting apparatus control system, the patient can be controllably raised and lowered as desired. The crane arm can be adjustably attached to a power T upright which is itself attached to a brace base. At least two beam extensions extend laterally from the brace and provide stability. This requires a gantry or rail and a power lift unit. Further, the patient has to be positioned in the lifting accessory, which may limit the utility of the lift.

United States Patent Application Publication No. 20170027796 discloses patient lift systems and lift accessories. In one example, a system may include a rail having a carriage support channel formed in the rail, the channel having a width, the rail has a working load rating; a carriage slidably disposed in the rail for relative movement to the rail, the carriage comprising a shaft having a length; and a lift unit coupled to the carriage and operable to raise and lower a lifting strap, wherein the lift unit has a working load rating; wherein the length of the shaft of the carriage is less than the width of the channel when the working load rating of the lift unit is equal to or less than the working load rating of the rail. In this manner, lift units that are incompatible with the working load rating of the rail cannot be connected with the rail. This requires a gantry or rail and a power lift unit. Further, the patient has to be positioned in the lifting accessory, which may limit the utility of the lift.

United States Patent Application Publication No. 20150136145 discloses a lifting system for lifting a person who is incapacitated, where the lifting system includes a torso enclosure that may encase a substantial portion of the person's torso without requiring the person to slip one or both of their arms through the enclosure, and orthogonally-aligned structural straps positioned on the enclosure to stabilize and strengthen the enclosure during use, where portions of the straps are detached between two respective junction points to permit grasping of such straps by others when attempting to lift the incapacitated person. This requires a gantry or rail and a power lift unit. Further, the patient has to be positioned in the lifting accessory, which may limit the utility of the lift.

United States Patent Application Publication No. 20130146629 discloses a lifting harness to allow a user to lift heavy objects without using excessive force from the hands, but to allow the load to be lifted by the user's legs and back. Two straps go across the users back and extend to near the fingertips of each arm. The user wraps the free ends of the straps around a load, such as handlebar handles, and grasps the strap ends, which applies friction, and then the load may be easily lifted. This harness would be very uncomfortable to use as it applies pressure to the shoulders, back and potentially, the neck of the user.

United States Patent Application Publication No. 20110023231 and 20100299830 disclose a device for assisting a caregiver in lifting and moving a patient. The device comprises a waist belt that includes a separate "glute" strap, which wraps around the patient's buttocks. Both the waist belt and the glute strap are fully adjustable to ensure a snug, comfortable fit. The device may further include a unitary garment member having a plurality of integral, reinforced support straps that enhance the structural strength of the garment member. The unitary garment member includes two flap portions extending laterally on opposing sides of a rear panel section that can be pulled forward and attached to a front panel section transforming the device into a vest-type garment that completely surrounds the patient's torso. The device includes a plurality of strategically positioned hand holds, which provide enhanced leverage enabling a caregiver to more easily assist a patient wearing the device to move from one position to another. The patient has to be positioned in the device, which may limit the utility of the device. Further, the device provides little mechanical advantage to the lifter, hence the weight lifted is still restricted by the strength of the lifter.

United States Patent Application Publication No. 20060162069 discloses a portable lifting apparatus for lifting and transferring of heavy objects. The lifting apparatus having a load-supporting platform which can be moved both vertically and rotated about the vertical axis of an upwardly extending lifting column. The lifting apparatus further includes an outrigger linkage coupled to the lifting column and is provided with a load support coupled to a retractable pulley. The lifting column is attached to a base and is normally prevented from rotating relative thereto. This is not a device that assists a lifter in moving a patient, but rather is in itself a lift, which would have to be located proximate to the patient's bed.

United States Patent Application Publication No. 20060137097 discloses a rescue device that comprises a floating head support slidably attached to a back support. The rescue device can be incorporated into other rescue apparatus, such as a rescue harness. In one embodiment, the harness comprises a mantle for wrapping around a patient's arms and torso. The mantle is secured with chest straps connected across the patient's chest with a fastener. The mantle includes a pocket for holding back supports of various lengths. Leg straps form leg loops for the patient's legs. One or more lifting rings are attached to the harness for lifting the harness. The harness can also include a harness protector. This requires a gantry or rail and a power lift unit. Further, the patient has to be positioned in the lifting accessory, which may limit the utility of the lift.

United States Patent Application Publication No. 20050132495 discloses a transfer stretcher, harness and method designed to lift, transfer or support a person, more specifically a heavy weight, large size (oversize) person. Stretchers are generally used by hospitals or by rescue/emergency units to lift or carry a person from one location to another. The transfer stretcher covered by the present invention is made of a supporting canvas equipped with lifting straps and rings, a removable washable comfort cloth, and maybe used with a removable safety harness that can be used with a stretcher basket and a sling frame. The transfer stretcher can be used to move a body manually with the help of several persons, or in combination with various lifting equipment. This requires a gantry or rail and a power lift unit. Further, the patient has to be positioned in the lifting accessory, which may limit the utility of the lift.

U.S. Pat. No. 6,729,511 discloses a shoulder harness made of straps forming a figure eight having a criss-cross strap configuration across a worker's back. Two adjustable sized loops are formed which hang under the worker's arms. A hook is threaded into each loop. A wide tension buckle is mounted from the hooks via carabiners, thereby centering the tension buckle in front of the worker. A web lift strap about six inches wide is threaded into the tension buckle. A second worker threads the opposite end of the lift strap into his tension buckle. The lift strap is placed under a load and carried by the two workers over rough surfaces that dolly wheels couldn't handle. Alternate embodiments include a central ring to join three or more workers' straps together, a hip carry mode which joins the two loops at a hip, and a two-strap mode for carrying loose objects. This harness would not be suitable for lifting a patient. Further, it would be uncomfortable as the load would be transferred to the users' shoulders.

U.S. Pat. No. 7,331,493 discloses a shoulder harness made of straps forming a figure eight having a criss-cross strap configuration, in one embodiment, across a user's back. Two loops are formed which hang under the user's arms. The loops may be threaded into slots on the top of a wide tension buckle, which is centered in front of the user. A webbed lift strap about five-inches wide is threaded into the base of the tension buckle. A second user threads the opposite end of the lift strap into the base of the second user's tension buckle. The lift strap is placed under a load and carried by the two users over rough surfaces that dolly wheels could not handle. Another embodiment includes a central ring to join three or more users' straps together. Another embodiment is a shoulder harness made of vertically hanging straps. This harness would not be suitable for lifting a patient. Further, it would be uncomfortable as the load would be transferred to the users' shoulders.

U.S. Pat. No. 4,280,645 discloses a harness for lifting heavy and bulky objects. The device provides for better lifting ability through superior load distribution and also provides for greater protection for the hands and arms of the person doing the lifting. A yoke type shoulder harness substantially spans the distance between the shoulders of the person wearing it while also circumscribing the neck area. Straps depend on the shoulder harness and are coupled with a rigid L-shaped support. The vertical leg of the L-shaped support substantially spans the distance between the hand and the elbow. The horizontal leg of the L-shaped support presents an enclosure having an opening for receiving at least a portion of the hand. A highly frictional covering on the upper surface of the horizontal leg holds objects in place. The strap means which couples the L-shaped supports with the shoulder harness includes buckle means for adjusting the effective length of the device. This harness would not be suitable for lifting a patient. Further, it would be uncomfortable as the load would be transferred to the users' shoulders.

Canadian Patent 2362089 discloses a harness lifting system 10 that is provided for team lifting of objects 10. Two harnesses 12, 14 are provided which are worn separately by two users 32. The system 10 includes two support lines or straps 16, 18. Each line 16, 18 has coupling points spaced from each other which removably attach to one of the harnesses 12, 14. The lines 16, 18 preferably link together at cross-over point 26 and then extend back to the same harness 12, 14 that the line 16, 18 first extends from the system 10 includes adjustability providing structures and accessories for optimal use to enhance the basic system 10. This harness would not be suitable for lifting a patient. Further, it would be uncomfortable as the lifting force is distributed to the shoulders and the back.

U.S. Pat. No. 8,657,166 discloses an apparatus that aids emergency personnel in transporting and carrying incapacitated people on stretchers or similar devices is herein disclosed. The apparatus comprises a belt worn by a user around the lower or middle back. The belt is designed to prevent back strain and injury by keeping the spine aligned and by forcing the user to maintain a proper posture when lifting a patient. The apparatus also comprises a harness to give additional support to the back and non-captive hook positioned on either the front or buckle area of the belt. The hook aids in supporting the stretcher or gurney when the user of the apparatus is an upright position. Its non-captive design allows for quick disconnection should the user stumble, fall or lose their balance. This apparatus would not increase the weight that a user would be able to lift. Further, it would be uncomfortable as the lifting force is distributed to the shoulders and the back.

What is needed is a lifting aid that can be worn by a worker to assist them in lifting a load. It would be preferable if it was a highly adjustable harness so as to fit a wide range of sizes of workers. It would be further preferable if it was lightweight and washable. It would be further preferable if it was designed using engineering principles and morphological considerations. It would be most preferable if it provided a mechanical advantage thus allowing the user to lift a weight greater than could be achieved without the lifting harness.

SUMMARY

The present technology is a lifting aid that can be worn by a worker to assist them in lifting a load. It is a highly adjustable harness that fits a wide range of sizes of workers. It is lightweight and washable. It is designed using engineering principles and morphological considerations. It provides a mechanical advantage thus allowing the user to lift a weight greater than could be achieved without the lifting harness.

In one embodiment, a lifting harness for assisting a worker to transfer a load is provided, the lifting harness comprising: a belt; a pair of lifting pads slidably mounted on the belt; a back including a pair of arms attached to the belt, the pair of arms converging towards a distal end; a loop proximate to the distal end; and a mobile lifting strap, the mobile lifting strap including a strap first distal end, a strap second distal end and a length therebetween, the length slidably extending through the loop; a first lifting loop proximate to the strap first distal end; and a second lifting loop proximate to the strap second distal end.

In the lifting harness, the back may include a leg extending between the loop and the arms.

In the lifting harness, the length may include a cylindrical section, the cylindrical section slidably extending through the loop.

In the lifting harness, the loop may a tunnel member.

In the lifting harness, the back may be adjustable.

In the lifting harness, the lifting pads each may include two apertures and the lifting pads may be threadedly, adjustably engage the belt.

In the lifting harness, the lifting pads may include a protrusion extending inward from the belt.

In the lifting harness, the lifting harness may comprise webbing.

In the lifting harness, the lifting loops may be padded.

The lifting harness may further comprise a first proximal lifting loop which is proximal to the first lifting loop and a second proximal lifting loop which is proximal to the second lifting loop.

In the lifting harness the lifting loops may be adjustable.

In the lifting harness, the mobile lifting strap may be adjustable.

In another embodiment, a method of transferring a load is provided, the method comprising: providing a user with a lifting harness which comprises a belt, a pair of lifting pads slidably mounted on the belt, a back including a pair of arms attached to the belt, the pair of arms converging towards a distal end, a tunnel loop proximate to the distal end, and a mobile lifting strap, the mobile lifting strap including a strap first distal end, a strap second distal end and a length therebetween, the length slidably extending through the tunnel loop, a first lifting loop proximate to the strap first distal end, and a second lifting loop proximate to the strap second distal end; the user donning the lifting hardness; adjusting the lifting pads on both sides of the user's waist, in the soft tissue between the user's lower rib cage and their pelvic brim; placing at least one wrist of the caregiver through a lifting loop on each of a left side and a right side of the mobile lifting strap; and lifting the load with the user's wrist.

The method may further comprise tightening the belt to create a protuberance in the lifting pads that indents the soft tissue.

The method may further comprise adjusting a length of the back.

In the method the load may be a patient.

In another embodiment, a transfer belt for a patient is provided, the transfer belt comprising: an adjustable belt; and a pair of lifting pads slidably mounted on the belt.

In the transfer belt, the lifting pads may threadedly, adjustably engage the belt.

In the transfer belt, the lifting pads may include a protrusion extending inward from the belt.

In the transfer belt, the protrusion may extend a length of the lifting pad.

In the transfer belt, the protrusion may be about 1 cm to about 3 cm thick.

In the transfer belt, the protrusion may be flexible or firm.

In yet another embodiment, a method of transferring a patient is provided, the method comprising: providing a patient with a transfer belt, the transfer belt including a belt and a pair of lifting pads mounted on the belt; adjusting the transfer belt on the patient such that the lifting pads are on both sides of the patient's waist, in the soft tissue between the patient's lower rib cage and their pelvic brim; exerting a force on the transfer belt; and changing the location of the patient, thereby transferring the patient.

DETAILED DESCRIPTION OF THE INVENTION

Except as otherwise expressly provided, the following rules of interpretation apply to this specification (written description and claims): (a) all words used herein shall be construed to be of such gender or number (singular or plural) as the circumstances require; (b) the singular terms "a", "an", and "the", as used in the specification and the appended claims include plural references unless the context clearly dictates otherwise; (c) the antecedent term "about" applied to a recited range or value denotes an approximation within the deviation in the range or value known or expected in the art from the measurements method; (d) the words "herein", "hereby", "hereof", "hereto", "hereinbefore", and "hereinafter", and words of similar import, refer to this specification in its entirety and not to any particular paragraph, claim or other subdivision, unless otherwise specified; (e) descriptive headings are for convenience only and shall not control or affect the meaning or construction of any part of the specification; and (f) "or" and "any" are not exclusive and "include" and "including" are not limiting. Further, the terms "comprising," "having," "including," and "containing" are to be construed as open-ended terms (i.e., meaning "including, but not limited to,") unless otherwise noted.

Recitation of ranges of values herein are merely intended to serve as a shorthand method of referring individually to each separate value falling within the range, unless otherwise indicated herein, and each separate value is incorporated into the specification as if it were individually recited herein. Where a specific range of values is provided, it is understood that each intervening value, to the tenth of the unit of the lower limit unless the context clearly dictates otherwise, between the upper and lower limit of that range and any other stated or intervening value in that stated range, is included therein. All smaller sub ranges are also included. The upper and lower limits of these smaller ranges are also included therein, subject to any specifically excluded limit in the stated range.

Unless defined otherwise, all technical and scientific terms used herein have the same meaning as commonly understood by one of ordinary skill in the relevant art. Although any methods and materials similar or equivalent to those described herein can also be used, the acceptable methods and materials are now described.

Figure 1:
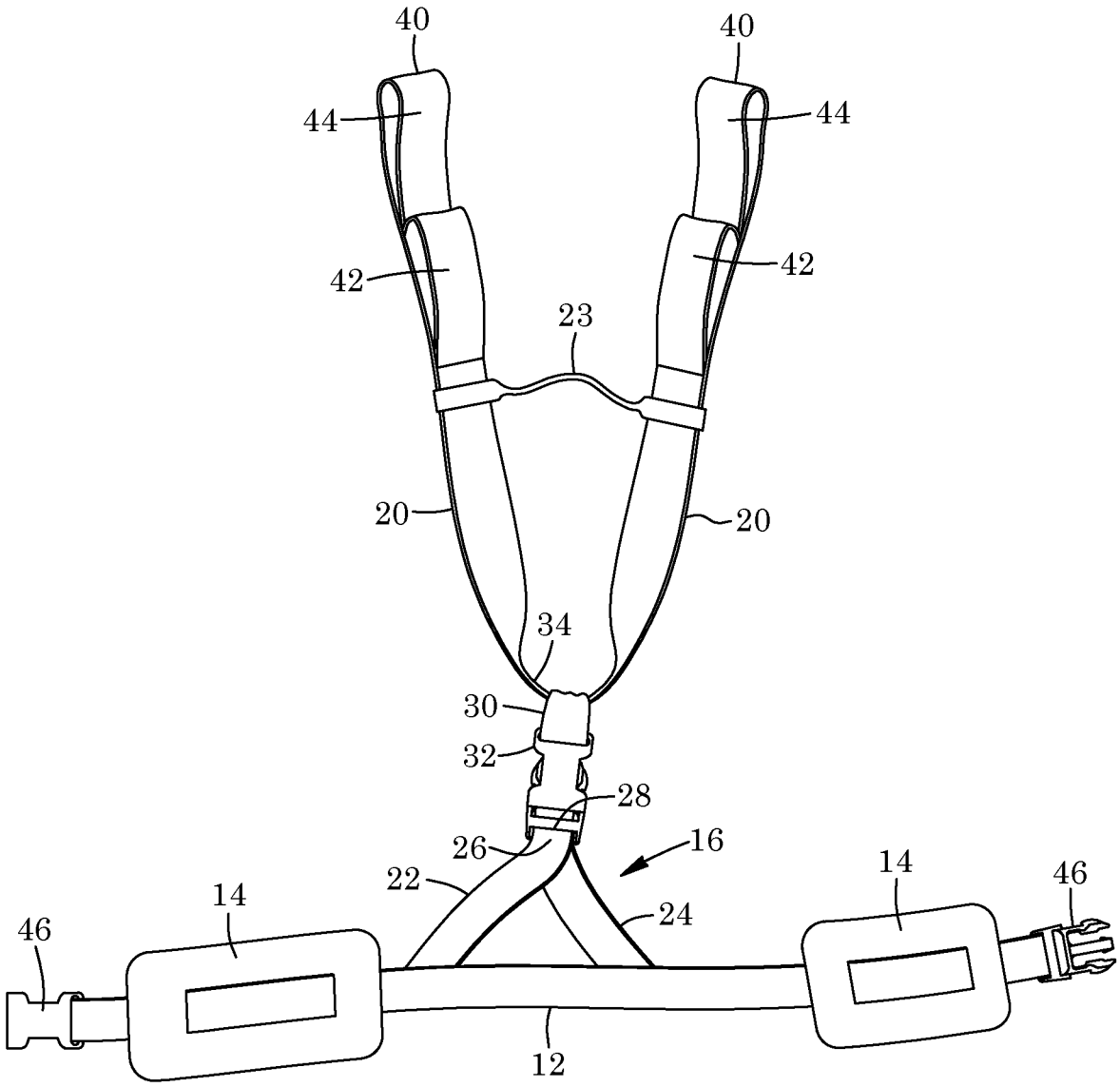
FIG. 1 is a schematic of the harness of the present technology.

A lifting harness, generally referred to as 10, is shown in FIG. 1. It includes a belt 12, lifting pads 14, which are slidably mounted on the belt 12, an inverted Y-shaped back, generally referred to as 16, a mobile lifting strap 20 and a stretchable chest strap 23 which is attached to each side of the mobile lifting strap 20. With the exceptions of the closures and adjustors, the lifting harness 10 is made of fabric and in the preferred embodiment, webbing.

The back 16 has two arms 22, 24 that are attached to the belt 12 and converge to a leg 26. The back 16 can be adjusted to different lengths for optimal fit. The distal end of the leg 28 is adjustably attached to a tunnel member 30, which in one embodiment is a loop of webbing. A suitable adjustor is a side quick release buckle 32. The tunnel member 30 is slidably mounted on a cylindrical section 34 which extends between the mobile lifting strap 20 and is continuous with them, thus the mobile lifting strap 20 and the cylindrical section 34 form one continuous mobile lifting strap. The distal ends 40 of the mobile lifting strap 20 are fitted with two padded loops, a proximal loop 42 and a distal loop 44, one proximal to the other. Vertical adjustment of the padded loops 42, 44 is accomplished by adjusting the length of the tunnel member 30 or leg 26 with the side quick release buckle 32.

In an alternative embodiment, the two arms 22, 24 converge at the side quick release buckle 32 and there is no leg 26. In either embodiment the two arms 22, 24 may be adjustably attached to the belt 12 with a side quick release buckle or may include an adjustor along their length, such as a cinch.

Figure 2A:
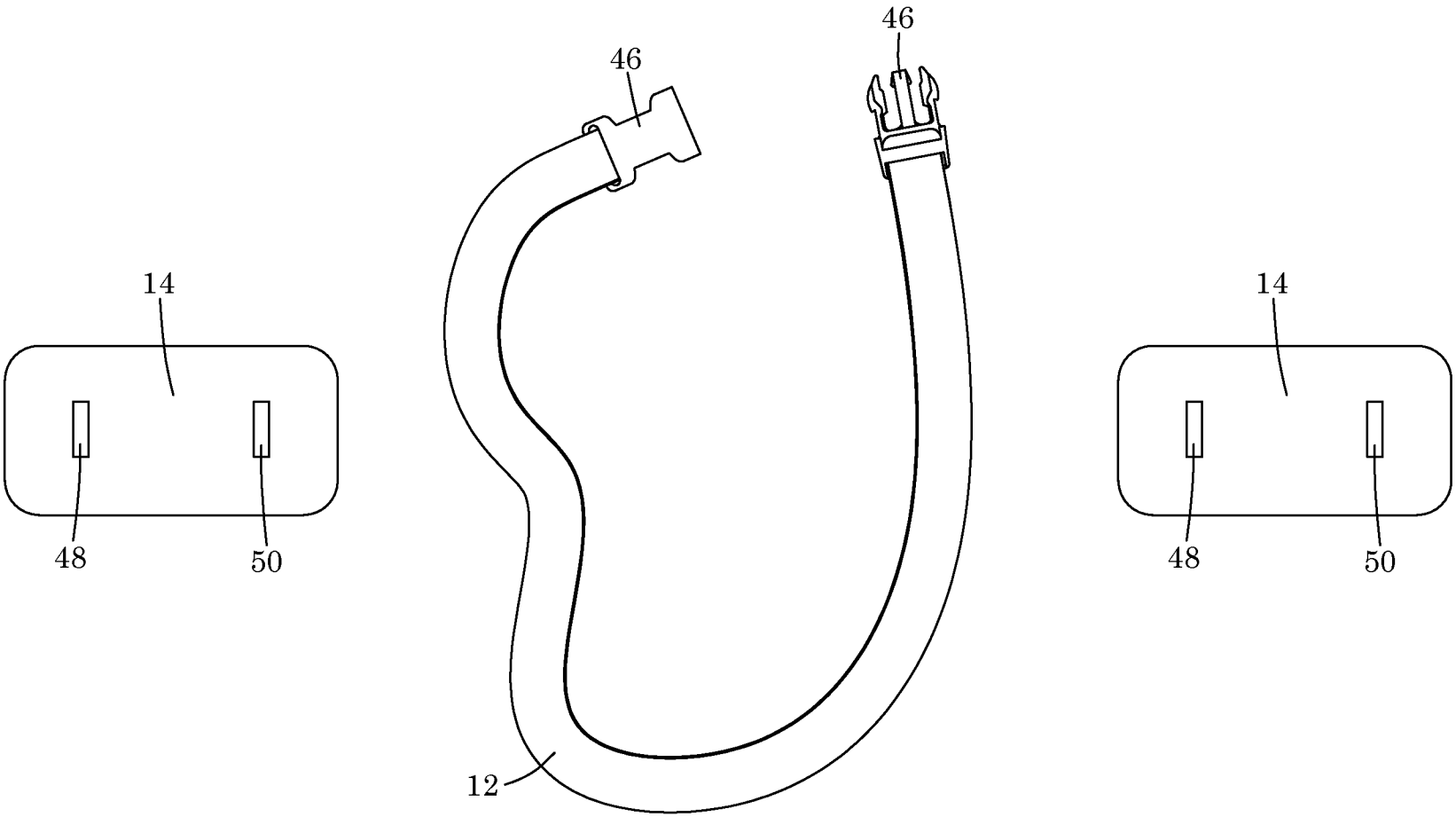
FIG. 2A is an exploded view of the belt of the harness of FIG. 1 or a transfer belt with flexible lifting pads.

As shown in FIG. 2A the belt 12 has an adjustable buckle 46 which is a side quick release buckle. Each lifting pad 14 has two apertures 48, 50 through which the belt 12 is threaded. This allows for horizontal adjustment of the lifting pads 14. The lifting pads 14 are to be located on the soft tissue of the torso between the lower rib cage and the pelvic brim. This lifting zone is where the soft tissues are easily displaced without injury or discomfort. In one embodiment, the lifting pads 14 form lifting ledges when the belt 12 is tightened around the user's waist, causing the lifting pads 14 to form protuberances which press into the soft tissue. The lifting pads are flexible. In another embodiment shown in FIG. 2B the lifting pads 14 are a soft material which includes a protuberance 52 which is thicker, for example, about 1 cm to about 3 cm deep and that extend inward from the belt 12. The protuberance 52 is soft. In another embodiment shown in FIG. 2C, the protuberance is firm or hard. In all embodiments, the lifting pad 14 itself or the lifting pad protuberance 52 protrude into the soft tissue on both sides of the waist between the lower rib cage and the pelvic brim.

Figure 3:
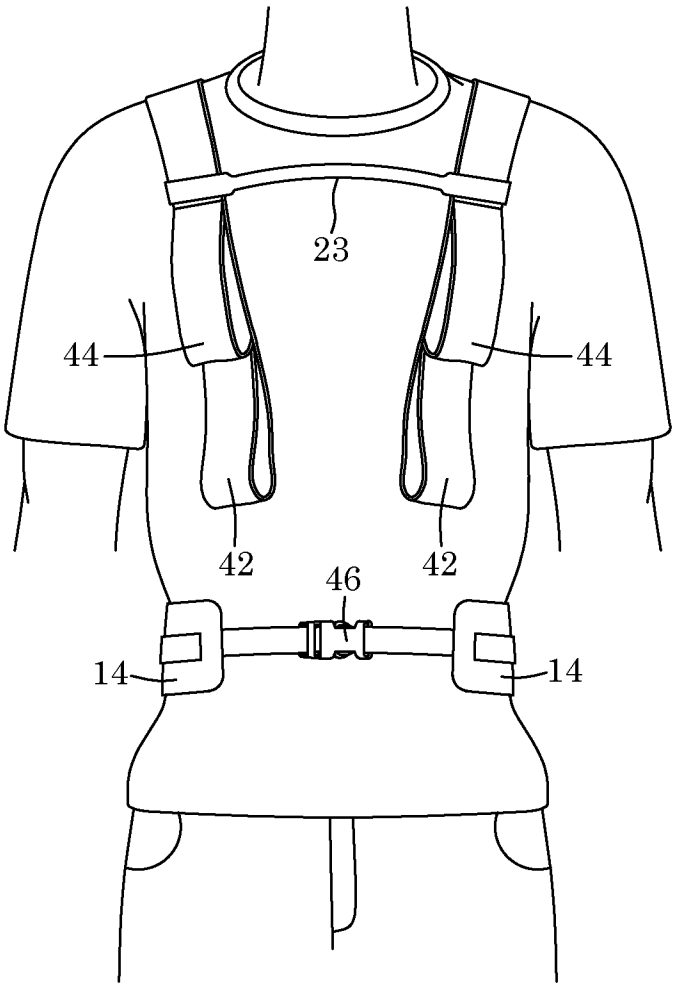
FIG. 3 is a front view of the harness on a worker.

FIG. 3 shows a back view of the harness 10 on a caregiver. The lifting pads 14 are correctly placed on the torso between the lower rib cage and the pelvic brim. The inverted Y-shaped back 16 transmits large upward vertical forces to the lifting pad 14 when the caregiver loads the harness 10.

Figure 4:
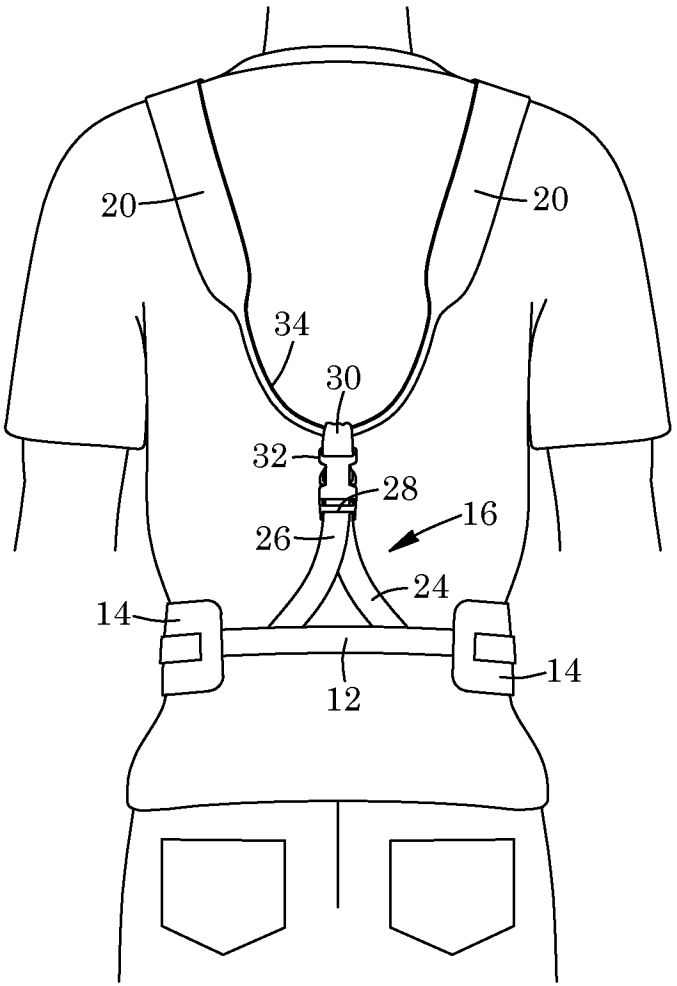
FIG. 4 is a back view of the harness on the worker.

FIG. 4 shows a front view of the harness 10 on the caregiver. The padded loops 42, 44 are positioned on the caregiver's chest ready for use. These can be adjusted vertically.

Figure 5:
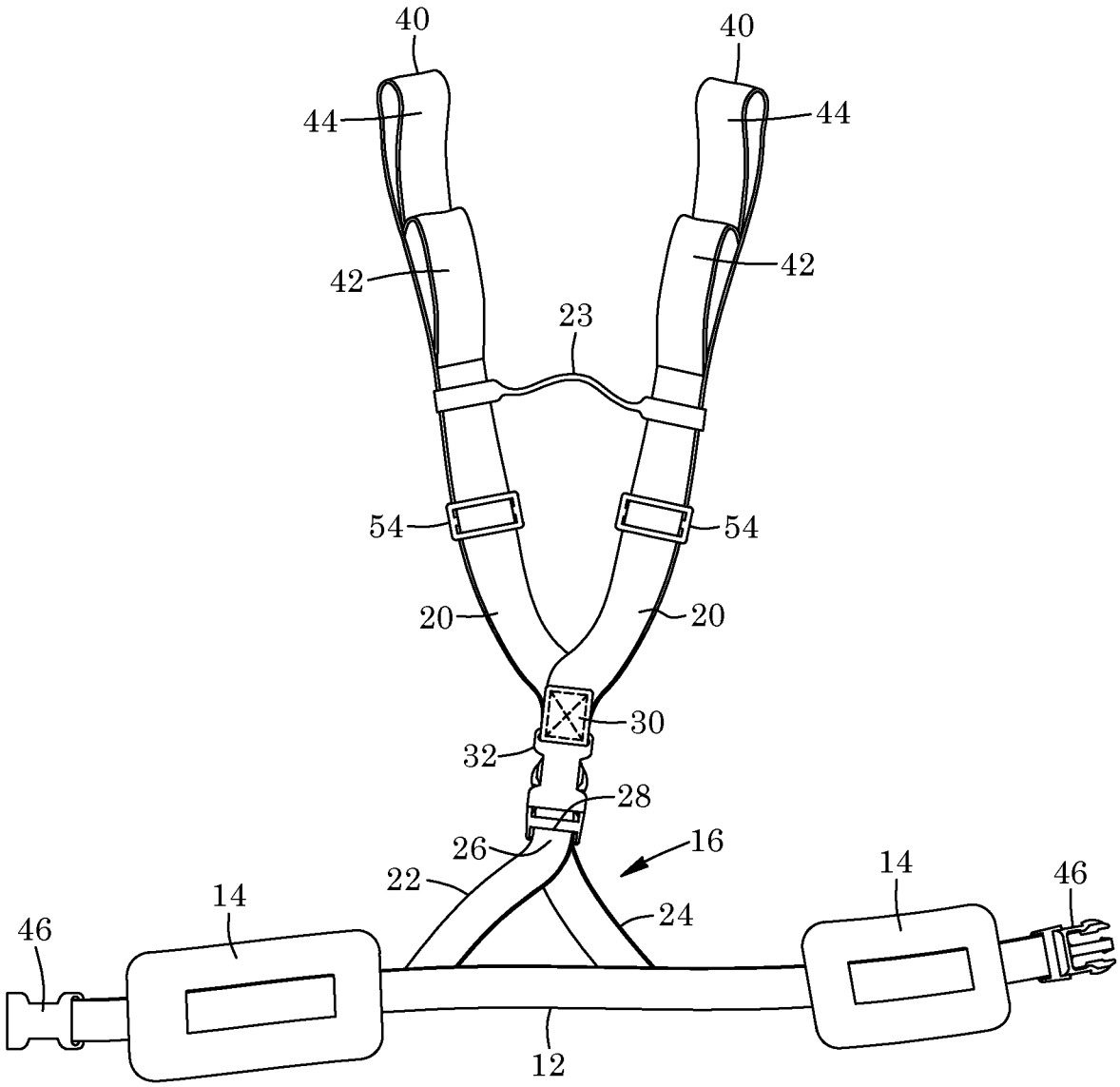
FIG. 5 is an alternative embodiment of the harness of FIG. 1.

In an alternative embodiment shown in FIG. 5, the shoulder straps are independent and each shoulder strap 18, 20 includes an adjustor 54 for adjusting the height of the padded loops 42, 44. In yet another embodiment, both the size and the height of the padded loops 42, 44 can be adjusted with adjustors on each padded loop 42, 44.

Figure 6A:
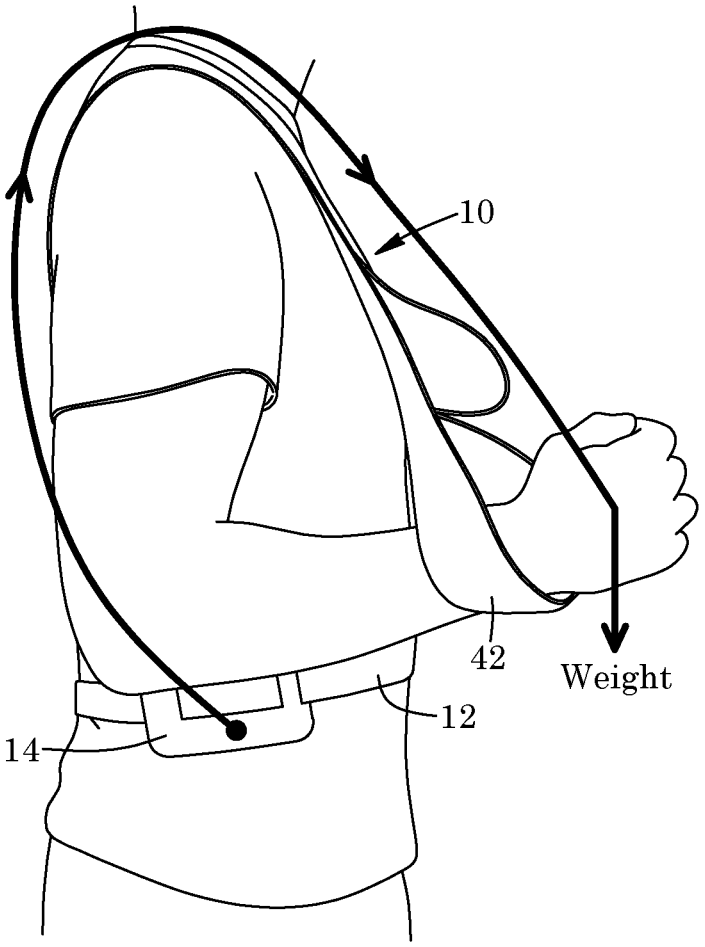
FIG. 6A is a side view of the harness on the worker showing loading of the forces on the harness and the worker.
Figure 6B:
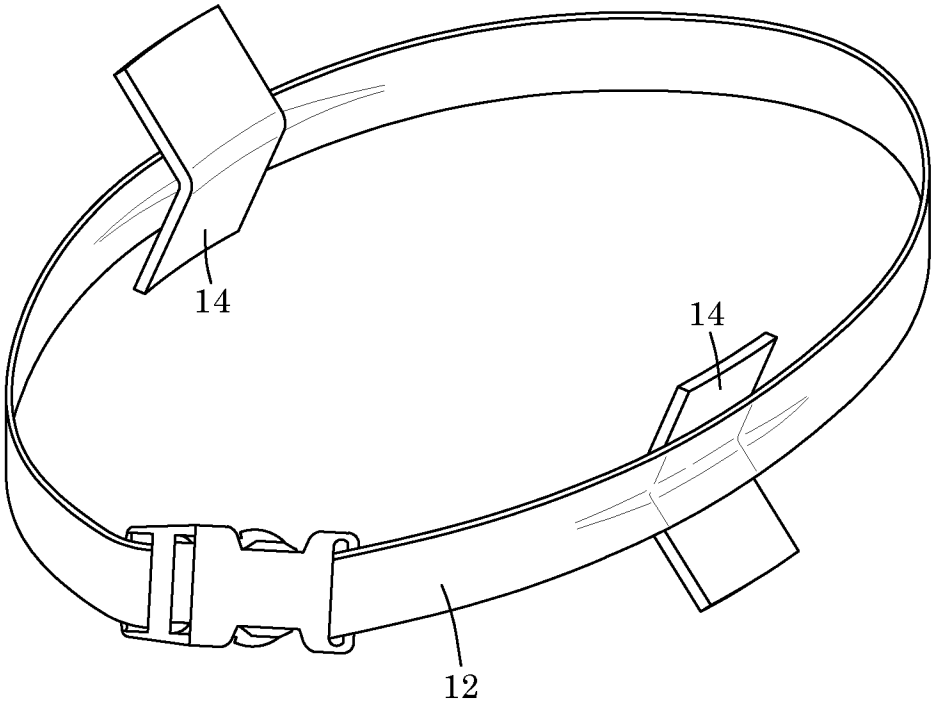
FIG. 6B shows the lifting pads protruding into the soft tissue of the user's torso.

FIG. 6A shows a side view of the harness 10 on the caregiver. The caregiver's wrists rest on the selected padded loops 42, 44, leaving the caregiver's hands free to grasp the patient. The arrows indicate the force exerted by the weight of the patient. Much of the weight is transferred to the lifting pads 14, which are pressed into the torso between the pelvic brim and the lower rib cage (the lifting zone) by the weight. There are various configurations that can be used by the caregiver, ranging from both wrists being in the same padded loop, for example 42 on both sides of the mobile lifting strap 20, to one wrist being in one padded loop 42 on one side while the other wrist is in another padded loop 44 on the other side, to one wrist remaining free and the other wrist resting on the loop 42 or 44 from both sides of the mobile lifting strap 20. Additionally, even if the wrists are in the same padded loop 42 or 44 on each side of the mobile lifting strap 20, one may be positioned higher than the other. Adjusting the position of the wrists is on the fly and allows for adjustments in and out, up and down and front to back. As shown in FIG. 6B, the lifting pads 14 provide horizontal grip as they indent the torso in the lifting zone. This lifting zone is where the soft tissues are easily displaced without injury or discomfort. The lifting pads 14 allow the caregiver to use the strength of their core, rather than the strength of their arms and shoulders to lift the patient. This allows the caregiver to lift a much higher weight than without the harness 10. Further, the harness 10 allows the caregiver to position themselves in a multitude of vertical and horizontal positions that are normally required when lifting and transferring a patient. The design of the harness 10 allows a caregiver or first responder to lift weights normally too large for the arm and shoulder muscles and to transfer the weight to large trunk and thigh muscles via the lifting pads 14. The mobile lifting strap 20 with 2 loops on either side translate into using one or both arms in a multitude of awkward vertical and horizontal positions that are normally required when lifting patients.

Figure 2B:
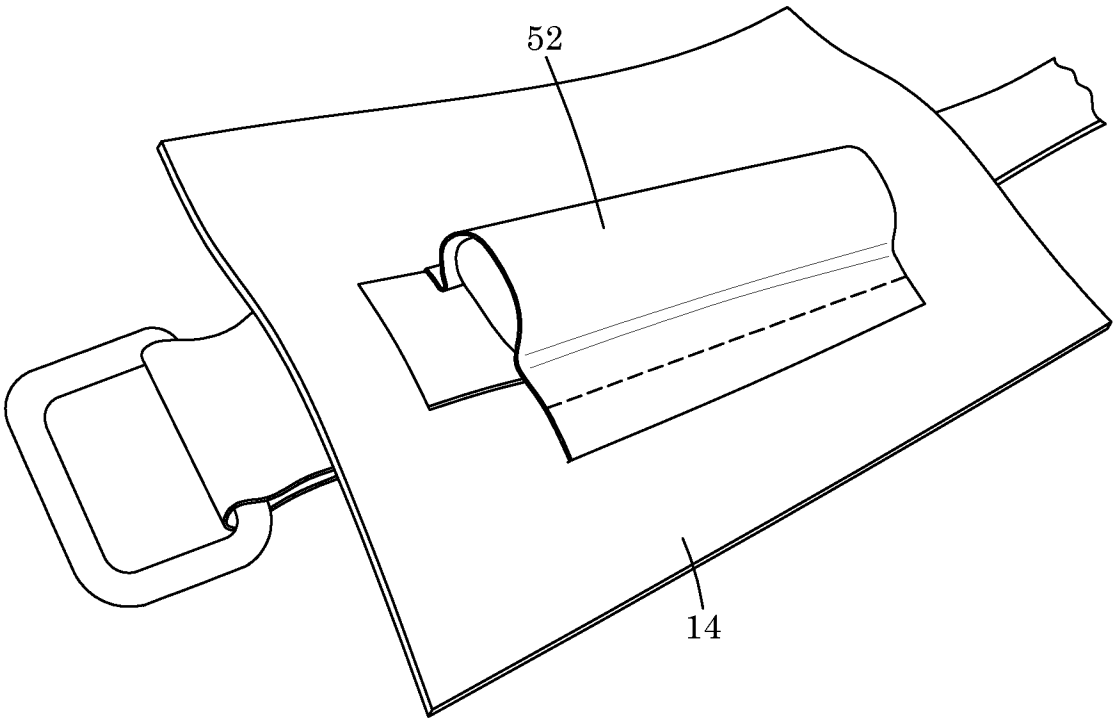
FIG. 2B is a perspective view of a flexible, soft protrusion on a lifting pad extending inward from the belt.
Figure 2C:
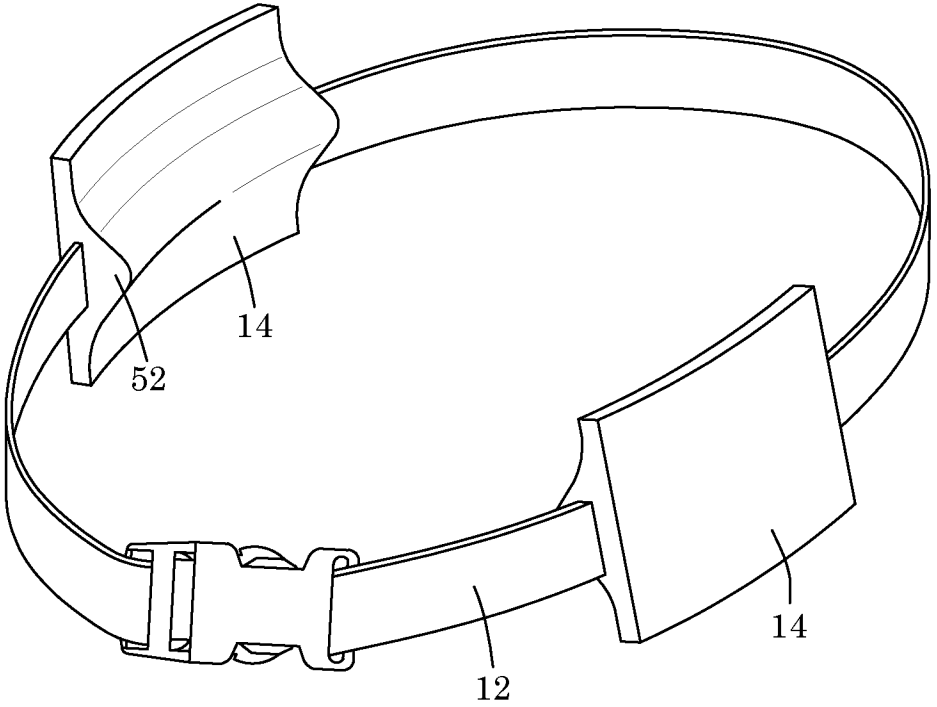
FIG. 2C is a perspective view of the belt with firm or hard protrusions on the lifting pads extending inward from the belt.

In another alternative embodiment, a pair of lifting pads are provided on a transfer belt, which is worn by a patient. This is analogues to what is depicted in FIGS. 2A and 2B. As shown in FIG. 2A, the belt 12, which is an exemplary transfer belt, has an adjustable buckle 46 which is a side quick release buckle. Each lifting pad 14 has two apertures 48, 50 through which the belt 12 is threaded. This allows for horizontal adjustment of the lifting pads 14. The lifting pads 14 are to be located on the soft tissue of the torso between the lower rib cage and the pelvic brim. This lifting zone is where the soft tissues are easily displaced without injury or discomfort. In one embodiment, the lifting pads 14 form lifting ledges when the belt 12 is tightened around the patient's waist, causing the lifting pads 14 to form protuberances which press into the soft tissue. In another embodiment shown in FIG. 2B, the lifting pads 14 are a firm material which includes a protuberance 52 which is thicker, for example, about 1 cm to about 3 cm deep and that extend inward from the belt 12, along the length of the lifting pad 14, such that they protrude into the soft tissue of the patient. When used with a transfer belt, the lifting pads 14 allow the force of lifting to be transferred to the soft tissue of the torso between the lower rib cage and the pelvic brim. This is much more comfortable for the patient. The transfer belt 12 is tightened around the patient and the lifting pads 14 are adjusted so that they are in the lifting zone. Force is exerted and the patient is moved.

In yet another embodiment, the transfer belt is integrated into an exoskeleton that fits a patient's torso. The exoskeleton or any extension of the transfer belt further distributes the weight of the patient. It includes attachment points, such as metal rings, to allow the patient to be attached to a lifting mechanism. The lifting pads and transfer belt function as described above, allowing the patient to be transferred, or brough from a sitting to a standing position with most of the pressure being exerted to the lifting zone.

While example embodiments have been described in connection with what is presently considered to be an example of a possible most practical and/or suitable embodiment, it is to be understood that the descriptions are not to be limited to the disclosed embodiments, but on the contrary, is intended to cover various modifications and equivalent arrangements included within the spirit and scope of the example embodiment. Those skilled in the art will recognize or be able to ascertain using no more than routine experimentation, many equivalents to the specific example embodiments specifically described herein. Such equivalents are intended to be encompassed in the scope of the claims, if appended hereto or subsequently filed.

The invention claimed is:

1. A lifting harness for assisting a worker to transfer a load, the lifting harness comprising: a belt; a pair of lifting pads slidably mounted on the belt; a back including a pair of arms attached to the belt, the pair of arms converging towards a distal end and a leg extending between the loop and the arms; a loop proximate to the distal end; and a mobile lifting strap, the mobile lifting strap including a strap first distal end, a strap second distal end and a length therebetween, the length including a cylindrical section, the cylindrical section slidably extending through the loop; a first lifting loop proximate to the strap first distal end; and a second lifting loop proximate to the strap second distal end.

2. The lifting harness of claim 1, wherein the loop is a tunnel member.

3. The lifting harness of claim 2, wherein the back is adjustable.

4. The lifting harness of claim 3, wherein the lifting pads each include two apertures and the lifting pads threadedly, adjustably engage the belt.

5. The lifting harness of claim 3, wherein each lifting pad includes a protrusion extending inward from the belt.

6. The lifting harness of claim 5, wherein the lifting harness comprises webbing.

7. The lifting harness of claim 6, wherein the lifting loops are padded.

8. The lifting harness of claim 7, further comprising a first proximal lifting loop which is proximal to the first lifting loop and a second proximal lifting loop which is proximal to the second lifting loop.

9. The lifting harness of claim 8, wherein the lifting loops are adjustable.

10. The lifting harness of claim 9, wherein the mobile lifting strap is adjustable.

11. A method of transferring a load, the method comprising: providing a user with a lifting harness which comprises a belt, a pair of lifting pads slidably mounted on the belt, a back including a pair of arms attached to the belt, the pair of arms converging towards a distal end, a loop proximate to the distal end, and a mobile lifting strap, the mobile lifting strap including a strap first distal end, a strap second distal end and a length therebetween, the length slidably extending through the loop, a first lifting loop proximate to the strap first distal end, and a second lifting loop proximate to the strap second distal end; the user donning the lifting hardness; adjusting the lifting pads on both sides of the user's waist, in the soft tissue between the user's lower rib cage and their pelvic brim; tightening the belt to create a protuberance in the lifting pads that indents the soft tissue; adjusting a length of the back; placing at least one wrist of the user through a lifting loop on each of a left side and a right side of the mobile lifting strap; and lifting the load with the user's wrist.

12. The method of claim 11, wherein the load is a patient.

* * * * *